US010458615B2

(12) United States Patent
Abe

(10) Patent No.: US 10,458,615 B2
(45) Date of Patent: Oct. 29, 2019

(54) VEHICLE LAMP

(71) Applicant: Ichikoh Industries, Ltd., Isehara-shi (JP)

(72) Inventor: Toshiya Abe, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 16/075,548

(22) PCT Filed: Feb. 3, 2017

(86) PCT No.: PCT/JP2017/004055
§ 371 (c)(1),
(2) Date: Aug. 3, 2018

(87) PCT Pub. No.: WO2017/135434
PCT Pub. Date: Aug. 10, 2017

(65) Prior Publication Data

US 2019/0056082 A1 Feb. 21, 2019

(30) Foreign Application Priority Data

Feb. 4, 2016 (JP) ..... 2016-019571

(51) Int. Cl.
*F21S 41/692* (2018.01)
*F21V 29/76* (2015.01)
(Continued)

(52) U.S. Cl.
CPC ..... *F21S 41/692* (2018.01); *F21S 41/00* (2018.01); *F21S 45/47* (2018.01); *F21V 29/76* (2015.01)

(58) Field of Classification Search
None
See application file for complete search history.

(56) References Cited

U.S. PATENT DOCUMENTS

2010/0124069 A1 5/2010 Nomura
2013/0051057 A1* 2/2013 Okubo ..... F21S 41/143 362/520
2013/0107564 A1* 5/2013 Yatsuda ..... F21S 45/48 362/543

FOREIGN PATENT DOCUMENTS

JP 2007-213938 A 8/2007
JP 2010-123403 A 6/2010
(Continued)

OTHER PUBLICATIONS

International Search Report dated Apr. 4, 2017, in PCT/JP2017/004055 filed Feb. 3, 2017.

*Primary Examiner* — Sharon E Payne
(74) *Attorney, Agent, or Firm* — Oblon, McClelland, Maier & Neustadt, L.L.P.

(57) ABSTRACT

In order to provide a vehicle lamp in which the number of components for enabling a shade to move is small, this vehicle lamp is equipped with a light source, a heat sink, a reflector that reflects light from the light source forward, a lens that radiates light forward, and a light distribution pattern switching part that is disposed between the lens and the light source. The light distribution pattern switching part is equipped with a bracket, a crank that is supported by a bracket support section, a shade that moves rotationally so as to switch the light distribution pattern, and a support shaft that rotatably supports the shade and is secured to the bracket. The crank is equipped with a rotating shaft section that is supported by the bracket support section so as to be able to rotate horizontally across the bracket, and a rotational movement section which is disposed on one end of the rotating shaft section and which causes the shade to move rotationally by rotating in the vertical direction around the rotating shaft. The support shaft is disposed so as to cut horizontally across the rotating shaft section of the crank so (Continued)

that the rotating shaft section of the crank does not separate from the bracket support section.

7 Claims, 7 Drawing Sheets

(51) Int. Cl.
*F21S 41/00* (2018.01)
*F21S 45/47* (2018.01)

(56) References Cited

FOREIGN PATENT DOCUMENTS

| | | | |
|---|---|---|---|
| JP | 2013-243034 | A | 12/2013 |
| JP | 2014-29820 | A | 2/2014 |
| JP | 2014-072139 | A | 4/2014 |

* cited by examiner

[FIG. 1]
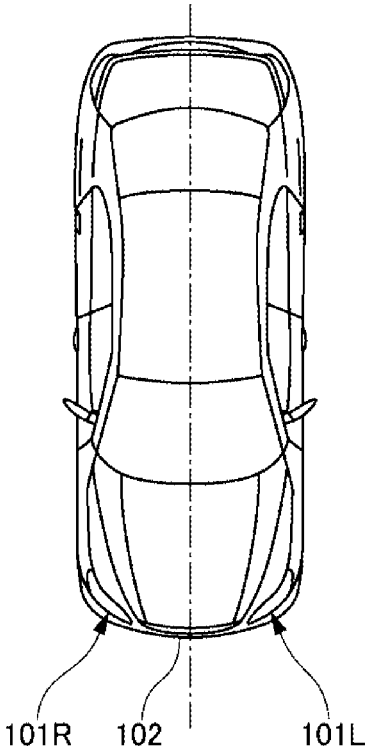

[FIG. 2]
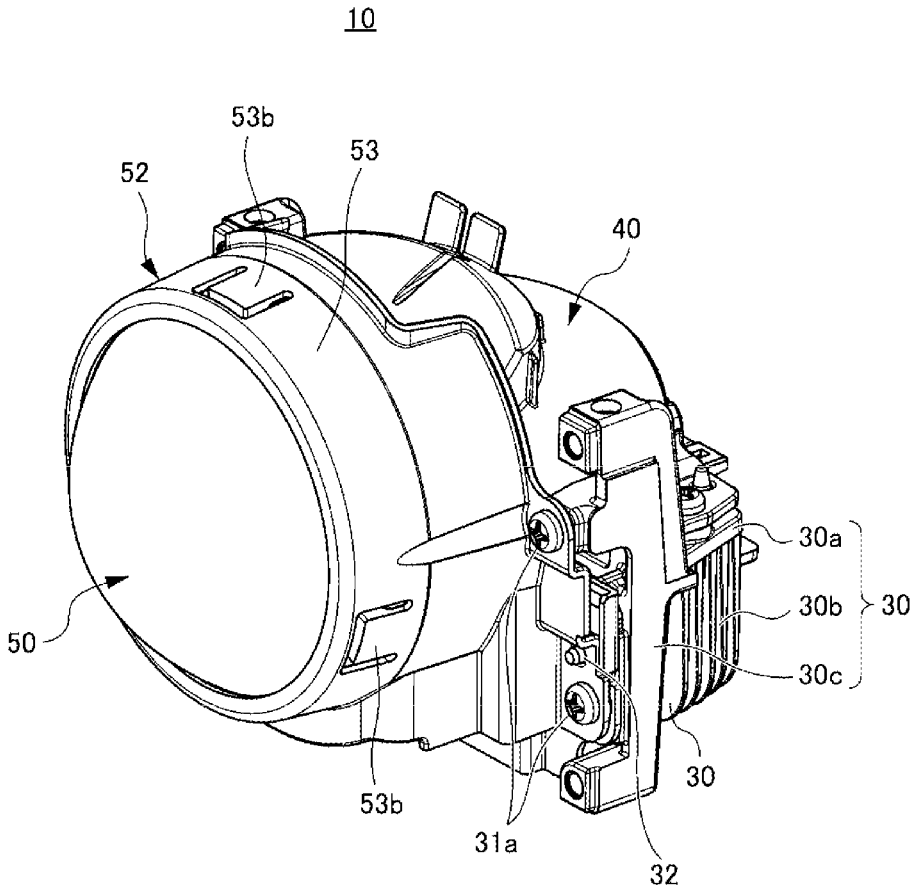

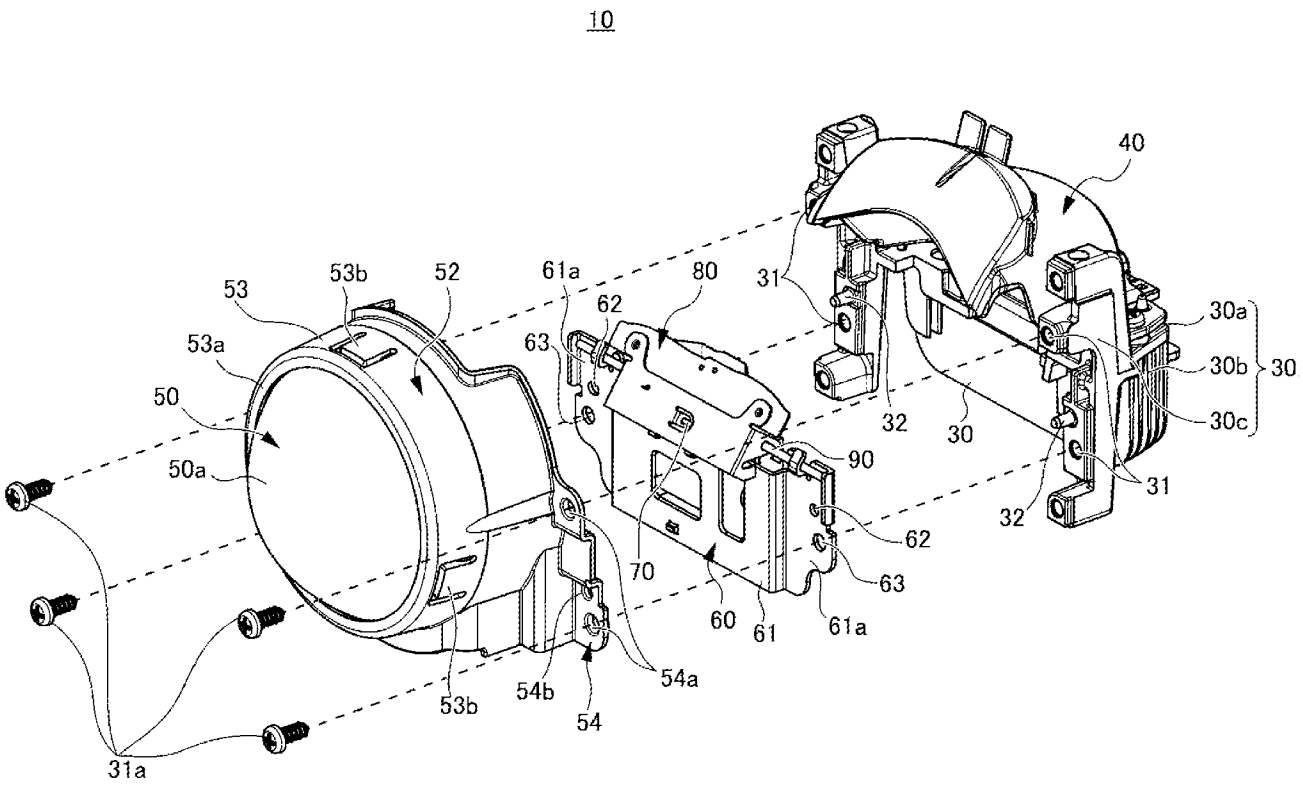
[FIG. 3]

[FIG. 4]
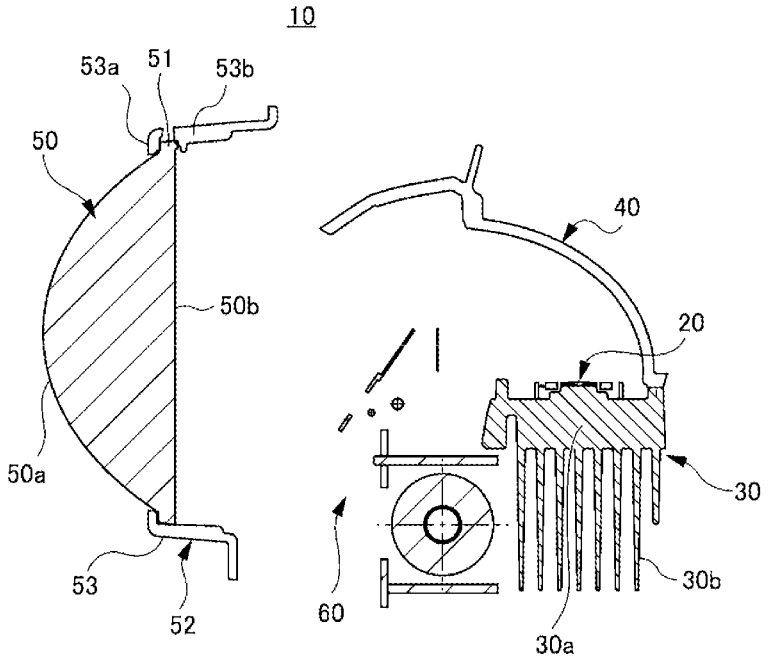

[FIG. 5]
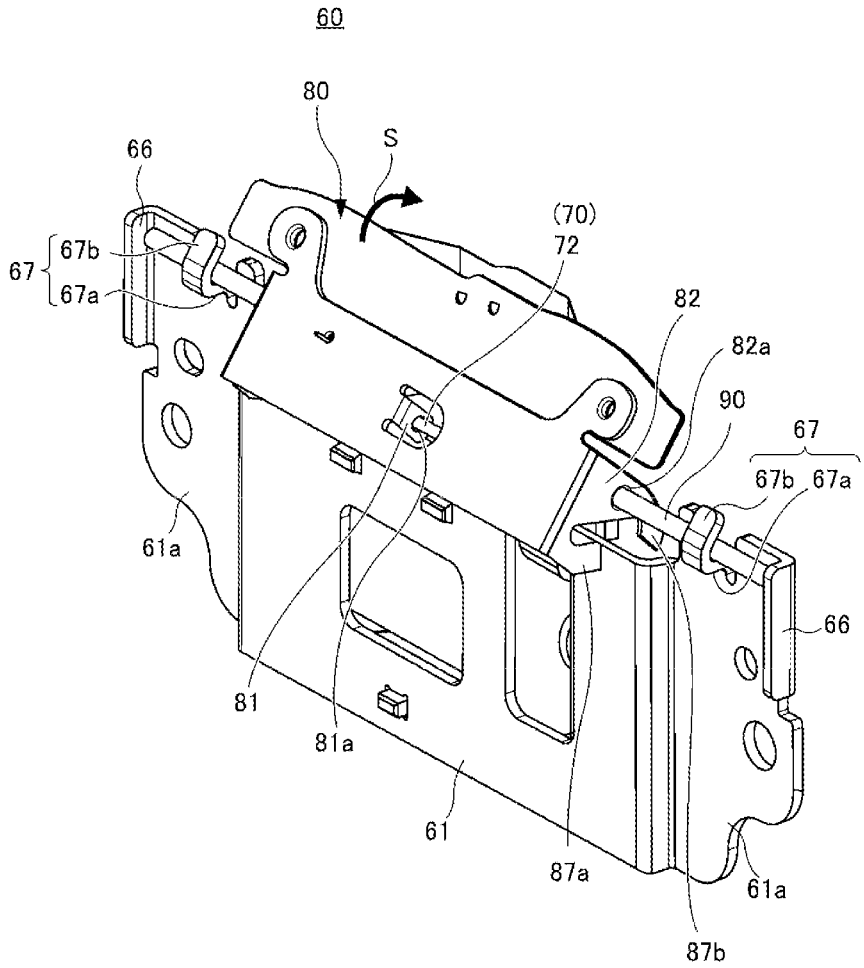

[FIG. 6]
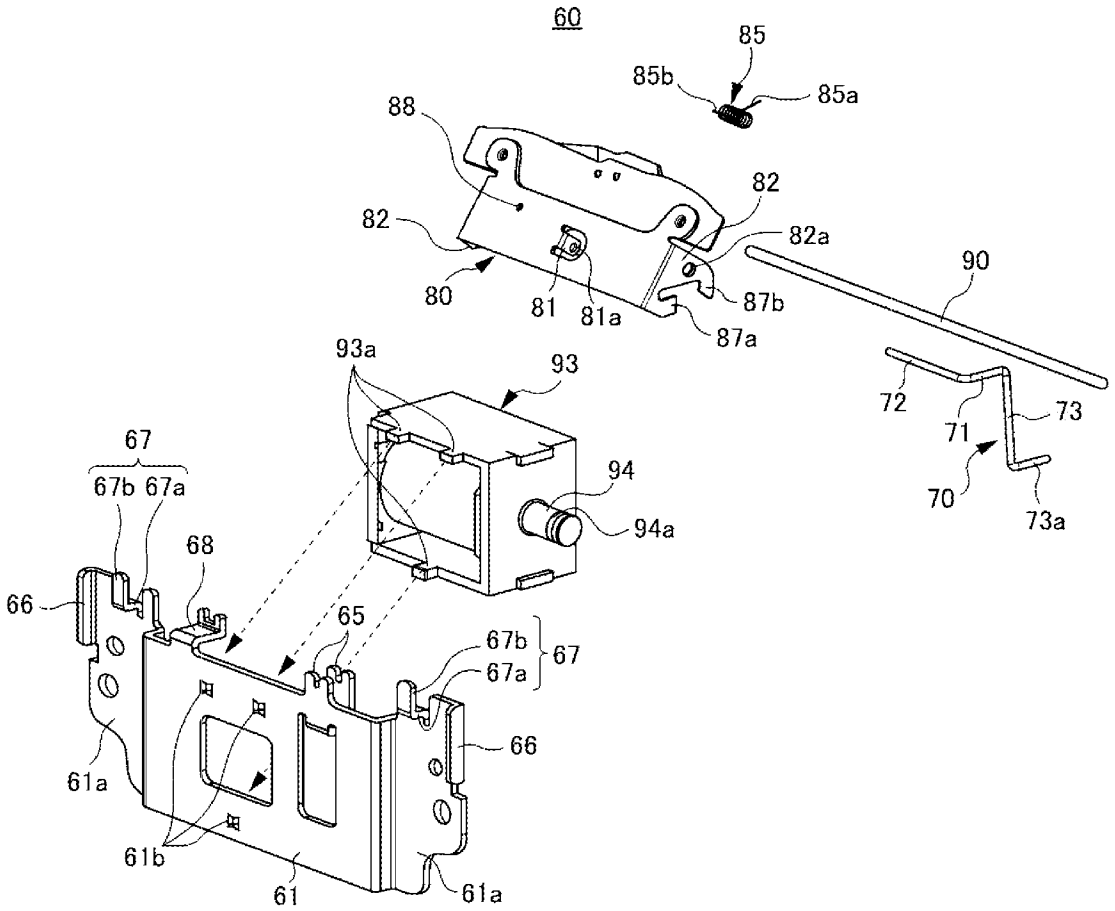

[FIG. 7]
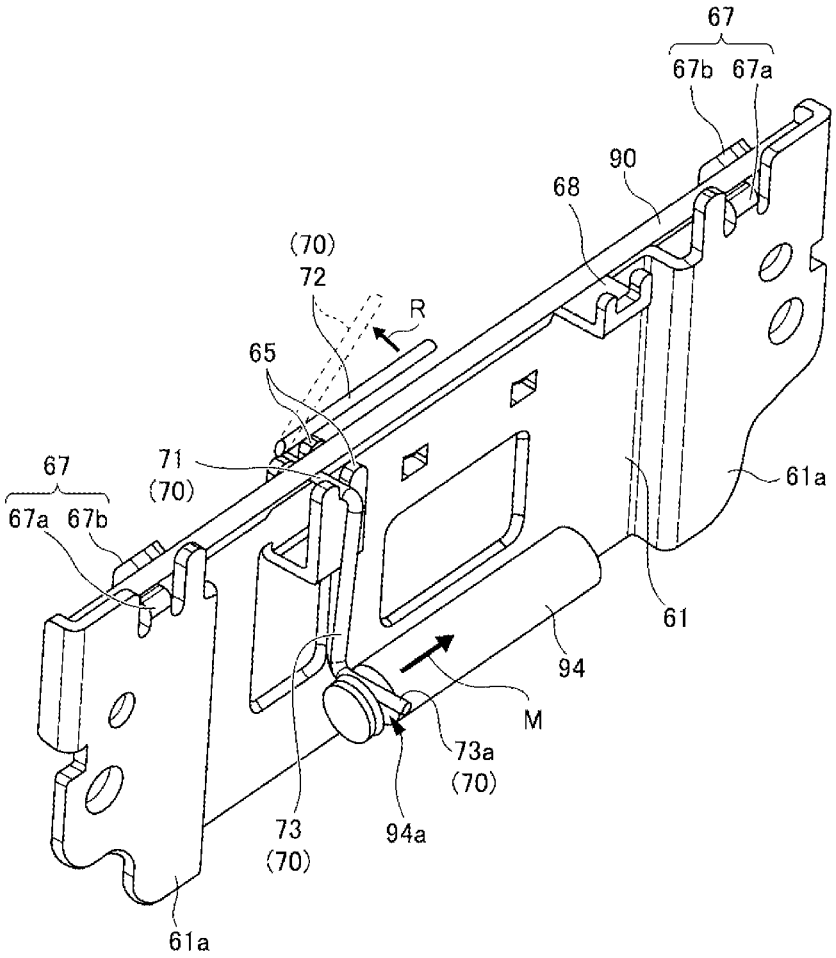

VEHICLE LAMP

TECHNICAL FIELD

The present invention relates to a vehicle lamp.

BACKGROUND ART

There has been conventionally known a vehicle head lamp in which a lamp unit is disposed in a lamp outer casing that is constituted by a lamp housing having an opening at least on one side thereof and a cover covering the opening of the lamp housing The lamp unit includes a light source unit having a light source, a movable shade that is rotatable and switches the shielding amount of light emitted from the light source, a solenoid that has an output shaft moving in a left-and-right direction and rotates the movable shade, a rotating shaft functioning as the fulcrum of rotation of the movable shade and having an axial direction aligned with the left-and-right direction, and an orthogonal transformation mechanism that converts the movement action of the output shaft into the rotation action of the movable shade At least a part of the rotating shaft is disposed above the solenoid (see Patent Literature 1).

CITATION LIST

Patent Literature

Patent Literature 1: Japanese Unexamined Patent Application Publication No 2014-72139

SUMMARY OF THE INVENTION

Problems to be Solved by the Invention

In the vehicle head lamp described in Patent Literature 1, a large number of components changing force transmission directions are interposed and thus the action of an output shaft of a solenoid moving in a vehicle horizontal direction can be used for the rotation of a movable shade.

The large number of components may cause an increase in the costs of the components and an increase in assembly costs.

Additionally, when a large number of components are interposed in power transmission and any of the components malfunctions, the movable shade also malfunctions accordingly Consequently, the possibility of malfunctions is increased.

It is thus desirable to enable the shade to be movable with a configuration having a reduced number of components.

The present invention has been achieved in view of the above problems, and an object of the invention is to provide a vehicle lamp including a reduced number of components for enabling a shade to be movable.

Means for Solving the Problem

In order to achieve the above object, the present invention is grasped by the following configurations.

(1) A vehicle lamp according to the present invention includes: a light source; a heat sink on which the light source is disposed; a reflector that is disposed above the heat sink and reflects light from the light source toward a front side; a lens that is disposed further front side than the light source and irradiates the light toward the front side; and a light distribution pattern switching part that is disposed between the lens and the light source and switches a light distribution pattern, wherein the light distribution pattern switching part includes a bracket, a crank that is supported by a support part of the bracket, a shade that performs a rotation action to switch the light distribution pattern, and a support shaft that rotatably supports the shade and is fixed on the bracket, the crank includes a rotating shaft part that extends across the bracket to be rotatably supported by the support part of the bracket, and a rotation action part that is formed at one end of the rotating shaft part and vertically rotates about the rotating shaft part to perform a rotation action of the shade, and wherein the support shaft is disposed to cross the rotating shaft part of the crank so as not to remove the rotating shaft part of the crank from the support part of the bracket.

(2) In the structure of above (1), a drive unit for rotating the crank is further included, wherein the crank includes a power transmission shaft part that is formed at the other end of the rotating shaft part and has a coupling part coupled to the drive unit at a distal end.

(3) In the structure of above (2), the drive unit is disposed on a vertically lower side on a side of the other end of the rotating shaft part, the power transmission shaft part extends vertically downward from the other end of the rotating shaft part so as to form a substantially L-shape with the rotating shaft part, and the coupling part at the distal end of the power transmission shaft part is coupled to the drive unit, and the rotation action part horizontally extends from the one end of the rotating shaft part so as to form a substantially L-shape with the rotating shaft part.

(4) In the structure of above (2) or (3), the drive unit is fixed to a rear surface of the bracket.

(5) In the structure of any one of above (1) to (4), the bracket includes paired support shaft fixing parts supporting the support shaft, disposed at a vertically upper portion of the bracket on one side and the other side of the bracket in a horizontal direction, and paired movement restriction parts restricting movement of one and the other ends of the support shaft being disposed in the support shaft fixing part, and wherein each of the support shaft fixing parts includes a receiving part having one end connected to the bracket and receiving the support shaft at a vertically lower portion of the receiving part, and a holding part extending from the other end of the receiving part vertically upward, pressing the support shaft toward a side of the bracket, and holding the support shaft with the bracket.

(6) In the structure of any one of above (1) to (5), the shade includes a first restriction part that abuts against a front surface of the bracket and sets a first position for blocking a part of the light, and a second restriction part that is disposed to be opposite to the first restriction part with the bracket being interposed therebetween, and in a case where the shade rotates from the first position to a second position for not blocking the light, when the shade rotates over the second position, the second restriction part abutting against a rear surface of the bracket.

(7) In the structure of any one of above (1) to (6), the bracket is fixed to the heat sink.

Effect of the Invention

The present invention can provide the vehicle lamp including a reduced number of components for enabling the shade to be movable.

BRIEF DESCRIPTION OF THE DRAWINGS

FIG. 1 is a plan view of a vehicle including a vehicle lamp according to an embodiment of the present invention.

FIG. 2 is a perspective view of a lamp unit according to the embodiment of the present invention.

FIG. 3 is a partially exploded perspective view of the lamp unit according to the embodiment of the present invention.

FIG. 4 is a cross-sectional view of the lamp unit according to the embodiment of the present invention.

FIG. 5 is a perspective view of a light distribution pattern switching part according to the embodiment of the present invention.

FIG. 6 is an exploded perspective view of the light distribution pattern switching part according to the embodiment of the present invention.

FIG. 7 is a partial perspective view of the light distribution pattern switching part according to the embodiment of the present invention.

MODE FOR CARRYING OUT THE INVENTION

A mode for carrying out the present invention (hereinafter, "embodiment") is described below in detail with reference to the attached drawings Like element are designated by like numerals throughout the description of the embodiment In the embodiment and the drawings, "front" and "rear" mean "moving forward direction" of a vehicle and "moving backward direction" of a vehicle, respectively, and "upper", "lower", "left", and "right" are used for directions as viewed from a driver in a vehicle, unless otherwise mentioned.

A vehicle lamp according to a first embodiment of the present invention is a vehicle lamp (101R, 101L) disposed on the left and right of the front of a vehicle 102 shown in FIG. 1 The left and right vehicle lamps (101R, 101L) basically have a similar configuration and thus are simply referred to as "vehicle lamp" hereinafter and only one of the left and right vehicle lamps is described.

The vehicle lamp according to the present embodiment includes a housing (not shown) that is open to a vehicle front side and an outer lens (not shown) that is attached to the housing so as to cover the opening A lamp unit 10 (see FIG. 2) and the like is disposed in a lamp chamber constituted by the housing and the outer lens.

FIG. 2 is a perspective view of the lamp unit 10 of the vehicle lamp according to the present embodiment FIG. 3 is a partially exploded perspective view of the lamp unit 10 and FIG. 4 is a cross-sectional view taken at the horizontal center of the lamp unit 10.

As shown in FIGS. 3 and 4, the lamp unit 10 includes a light source 20 (see FIG. 4), a heat sink 30 on which the light source 20 is disposed, a reflector 40 that is disposed above the heat sink 30 and reflects light from the light source 20 toward the front side, a lens 50 that is disposed further front side than the light source 20 and irradiates light toward the front side, a lens holder 52 for attaching the lens 50 to the heat sink 30, and a light distribution pattern switching part 60 that is disposed between the lens 50 and the light source 20 and switches light distribution patterns.

Light Source

The light source 20 is a semiconductor light source having light-emitting chips arranged on a substrate, and an LED is used in the present embodiment.

The shape and number of light-emitting chips used for the substrate are not particularly limited For example, a plurality of square light-emitting chips may be arranged horizontally on the substrate, thus forming a rectangular light-emitting surface Alternatively, only a rectangular light-emitting chip may be arranged on the substrate, thus forming a rectangular light-emitting surface.

Alternatively, only a square light-emitting chip may be arranged on the substrate, thus forming a square light-emitting surface.

While the present embodiment describes the case of using an LED, semiconductor light sources such as an LD and an EL (an organic EL) may be used.

Heat Sink

As shown in FIG. 4, the heat sink 30 includes a base 30*a* on which the light source 20 is disposed, a plurality of radiation fins 30*b* that extend vertically downward from the base 30*a* and are arranged in a vehicle front-and-rear direction, and an attachment part 30*c* that, as shown in FIG. 3, is disposed further front side than the base 30*a* and the radiation fins 30*b* and on left and right sides in a horizontal direction, and attaches thereto the light distribution pattern switching part 60 and the lens holder 52.

As shown in FIG. 3, the attachment part 30*c* includes two pairs of horizontally paired screw fixing holes 31 at vertically upper and lower portions thereof, that is, four screw fixing holes 31 in total for the purpose of fixing screws 31*a* therein The attachment part 30*c* also includes horizontally paired left and right positioning bosses 32.

Reflector

As shown in FIG. 4, the reflector 40 is disposed above the base 30*a* of the heat sink 30 so as to cover the light source 20 in a half dome shape, and reflects light from the light source 20 toward the front side in a predetermined light distribution pattern.

Lens

The lens 50 is made of a transparent material such as an acryl-based resin, a polycarbonate-based resin, or glass.

While an aspheric lens that is substantially circular as viewed from the front, and includes, as shown in FIG. 4, a light-emitting surface 50*a* that is a curved surface projecting toward the front side and a light incident surface 50*b* that is substantially flat is used as the lens 50 in the present embodiment, the lens 50 is not limited to the aspheric lens.

As shown in FIG. 4, the lens 50 also includes a flange 51 held by the lens holder 52 at the outer peripheral portion thereof.

Lens Holder

The lens holder 52 is interposed between the lens 50 and the heat sink 30 and is used for attaching the lens 50 to the heat sink 30.

As shown in FIGS. 3 and 4, the lens holder 52 includes a cylindrical lens fixing part 53 having a peripheral edge 53*a* abutting against the flange 51 of the lens 50 and a holding piece 53*b* which holds the flange 51 of the lens 50 with the peripheral edge 53*a*.

Additionally, the lens holder 52 includes a pair of left and right attachment parts 54 on its side of the heat sink 30 The attachment parts 54 include screw holes 54*a* corresponding to the four screw fixing holes 31 formed in the attachment part 30*c* of the heat sink 30 and boss holes 54*b* corresponding to the two positioning bosses 32 formed on the attachment part 30*c* of the heat sink 30.

As shown in FIG. 3, a bracket 61 of the light distribution pattern switching part 60 includes paired flanges 61*a* disposed on the left and right sides in the horizontal direction Each of the paired flanges 61*a* includes a boss hole 62 corresponding to each of the paired positioning bosses 32 in the heat sink 30 and a screw hole 63 that is formed vertically below the boss hole 62 and corresponds to each of the paired screw fixing holes 31 formed in the vertically lower portion of the heat sink 30.

The light distribution pattern switching part 60 is assembled to the heat sink 30 so that the positioning boss 32 of the heat sink 30 passes through the boss hole 62 of the light distribution pattern switching part 60 The lens holder 52 having the lens 50 attached thereto is then assembled to the heat sink 30 so that the positioning boss 32 of the heat sink 30 passes through the boss hole 54*b* of the lens holder 52 Finally, the screws 31*a* pass through the screw holes 54*a* of the lens holder 52 and the screw holes 63 of the light distribution pattern switching part 60 to be screwed into the screw fixing holes 31 of the heat sink 30 and fixed therein, so that the lamp unit 10 shown in FIG. 2 is obtained.

Light Distribution Pattern Switching Part

FIG. 5 is a perspective view of the light distribution pattern switching part 60 FIG. 6 is an exploded perspective view of the light distribution pattern switching part 60.

As shown in FIG. 6, the light distribution pattern switching part 60 includes the bracket 61, a crank 70, a shade 80 for switching light distribution patterns, a support shaft 90 for supporting the shade 80, a twisted coil spring 85 having paired urging arms 85*a*, 85*b* extending from both ends of the coil, and a solenoid 93 that is fixed to the bracket 61 and functions as a drive unit.

While the solenoid 93 is used as the drive unit in the present embodiment, the drive unit is not limited to the solenoid 93 and any component capable of operating similarly may be used as the drive unit.

The solenoid 93 is a drive source for the shade 80 that switches light distribution patterns, and is fixed to a rear surface of the bracket 61.

Such a fixture state is specifically described The solenoid 93 has three rivets 93*a* in the present embodiment The bracket 61 includes three through-holes 61*b* for enabling the rivets 93*a* of the solenoid 93 to pass therethrough.

The solenoid 93 is disposed on the rear surface of the bracket 61 so that the rivets 93*a* pass through the through-holes 61*b* from the rear side of the bracket 61 (the side of the heat sink 30) The rivets 93*a* projecting from the front surface of the bracket 61 are then caulked, so that the solenoid 93 is fixed to the rear surface of the bracket 61.

The solenoid 93 includes a drive shaft 94 that is most projected when a power supply is in an off-state and is most retracted when the power supply is in an on-state An engagement groove 94*a* for coupling to a coupling part 73*a* of the crank 70 to be described later is formed at a distal end of the drive shaft 94.

Paired support parts 65 are formed in the bracket 61 The support parts 65 are formed on the vertically upper portion of the bracket 61, and include recesses that form a pair in the front-and-rear direction for the purpose of supporting the crank 70.

The crank 70 includes a rotating shaft part 71, a rotation action part 72, and a power transmission shaft part 73 The rotating shaft part 71 extends across the bracket 61 in the front-and-rear direction to be rotatably supported by the support parts 65 of the bracket 61 The rotation action part 72 extends horizontally from one end of the rotating shaft part 71 along the bracket 61 so as to form a substantially L-shape with the rotating shaft part 71 and rotates vertically about the rotating shaft part 71 The power transmission shaft part 73 is used for rotating the rotating shaft part 71, extends vertically from the other end of the rotating shaft part 71 along the bracket 61 so as to form a substantially L-shape with the rotating shaft part 71, and has the coupling part 73*a* at its distal end The coupling part 73*a* is coupled to the engagement groove 94*a* of the drive shaft 94 in the solenoid 93.

The coupling part 73*a* of the power transmission shaft part 73 disposed on the other end side of the rotating shaft part 71 is coupled to the drive shaft 94 of the solenoid 93 Consequently, the solenoid 93 is disposed on the rear side of the bracket 61 in the present embodiment so as to be disposed on the other end side of the rotating shaft part 71.

Although an operation is described later, the shade 80 includes, as shown in FIGS. 5 and 6, a crank coupling part 81 having a coupling hole 81*a* used for coupling of the distal end side of the rotation action part 72 of the crank 70 The rotation action part 72 of the crank 70 rotates about the rotating shaft part 71 in the vertical direction, and thus the shade 80 rotatably supported by the support shaft 90 performs a rotation action, as shown in FIG. 5.

The shade 80 includes a pair of bent parts 82 bent rearward and disposed on the left and right sides in the horizontal direction Each of the bent parts 82 includes a shaft hole 82*a* into which the support shaft 90 supporting the shade 80 is inserted.

Meanwhile, the bracket 61 includes a pair of left and right flanges 61*a* in the horizontal direction Each of the flanges 61*a* is bent toward the vehicle rear side and then bent to horizontally extend As can be seen from FIG. 5, the bracket 61 includes a pair of support shaft fixing parts 67 at the vertically upper portion of the bracket 61 (the upper side of the drawing) on one side (the left side of the drawing) and the other side (the right side of the drawing) of the bracket 61 in the horizontal direction The support shaft fixing parts 67 fix the support shaft 90 that rotatably supports the shade 80 More specifically, the bracket 61 includes the paired support shaft fixing parts 67 formed in the paired flanges 61*a* on the one side (the left side of the drawing) and the other side (the right side of the drawing) of the bracket 61 in the horizontal direction.

The support shaft fixing part 67 is described in further detail The support shaft fixing part 67 includes a receiving part 67*a* having one end connected to the bracket 61 (more specifically, the flange 61*a*) and receiving the support shaft 90 at the vertically lower portion thereof and a holding part 67*b* extending vertically upward from the other end of the receiving part 67*a*, pressing the support shaft 90 toward the side of the bracket 61 (more specifically, the side of the flange 61*a*), and holding the support shaft 90 with the bracket 61 (more specifically, the flange 61*a*).

Additionally, the bracket 61 includes a pair of movement restriction parts 66 restricting the movement of the one end (the left side of the drawing) and the other end (the right side of the drawing) of the support shaft 90 being disposed in the support shaft fixing part 67 More specifically, the bracket 61 includes the paired movement restriction parts 66 that are formed by bending horizontal ends of the paired flanges 61*a* of the bracket 61 toward the front side and that restrict the movement of the one end (the left side of the drawing) and the other end (the right side of the drawing) of the support shaft 90 being disposed in the support shaft fixing part 67.

As shown in FIG. 6, the bracket 61 includes an arm receiving part 68 having a recess for receiving the urging arm 85*a* of the twisted coil spring 85 at the vertically upper portion of the bracket 61 on the left side of the drawing The shade 80 includes a receiving hole 88 for receiving the urging arm 85*b* of the twisted coil spring 85.

The light distribution pattern switching part 60 with the configuration described above is assembled by, for example, the following procedure As a result, the light distribution pattern switching part 60 shown in FIG. 5 is achieved.

As described above, the solenoid 93 is fixed to the bracket 61 first.

Next, the support shaft 90 is made to pass through the shaft hole 82*a* in one bent part 82 of the shade 80 The twisted coil spring 85 is then attached to the support shaft 90 having passed through the shaft hole 82*a* from the distal end side of the support shaft 90 so that the support shaft 90 passes through the center of the twisted coil spring 85 At the same time, the urging arm 85*b* of the twisted coil spring 85 attached to the support shaft 90 is inserted into the receiving hole 88 of the shade 80.

The support shaft 90 is then made to pass through the shaft hole 82*a* in another bent part 82 of the shade 80, so that the support shaft 90 passes through the shaft holes 82*a* in the paired bent parts 82 of the shade 80.

Moreover, the distal end side of the rotation action part 72 of the crank 70 is inserted into the coupling hole 81*a* in the crank coupling part 81 of the shade 80.

The support shaft 90, the twisted coil spring 85, and the crank 70 are attached to the shade 80 as described above The urging arm 85*a* of the twisted coil spring 85 is then disposed in the recess of the arm receiving part 68 of the bracket 61, and the rotating shaft part 71 of the crank 70 is disposed to extend across the pair of support parts 65.

When the rotating shaft part 71 of the crank 70 is disposed to extend across the pair of support parts 65, the coupling part 73*a* of the power transmission shaft part 73 in the crank 70 is coupled to the engagement groove 94*a* of the drive shaft 94 in the solenoid 93.

The support shaft 90 is then disposed in the support shaft fixing part 67 of the bracket 61 so as to cross the rotating shaft part 71 of the crank 70 between the paired support parts 65, and the holding part 67*b* of the support shaft fixing part 67 is slightly bent for the purpose of fixing the support shaft 90 to the bracket 61.

Next, the light distribution pattern switching part 60 assembled as described above is described in further detail while explaining an operation of the light distribution pattern switching part 60 and the like.

FIG. 7 is a partial perspective view showing only a part of members of the light distribution pattern switching part 60 assembled as described above.

Specifically, FIG. 7 is a partial perspective view showing only the bracket 61, the crank 70, the support shaft 90, and the drive shaft 94 of the solenoid 93.

As can be seen from FIG. 7, the support shaft 90 is disposed to cross the rotating shaft part 71 of the crank 70 so that the rotating shaft part 71 of the crank 70 is not removed from the paired support parts 65 of the bracket Consequently, when receiving vibration, the crank 70 is not removed from the paired support parts 65.

Additionally, the support shaft 90 has such a removal prevention function, and thus the number of components is not increased.

When a power supply of the solenoid 93 is switched on, as shown by an arrow M in FIG. 7, the drive shaft 94 is moved The rotation action part 72 then performs a rotation action about the rotating shaft part 71 of the crank 70 in the vertical direction, as shown by an arrow R in FIG. 7 That rotates the shade 80 as shown by an arrow S in FIG. 5.

The position of the shade 80 changes from a first position before rotation shown in FIG. 5 where a low-beam light distribution pattern of blocking a part of light from the light source 20 is formed to a second position where a high-beam light distribution pattern of not blocking light is formed, so that a light distribution pattern is switched.

The horizontal movement of the drive shaft 94 of the solenoid 93 is transmitted by only the crank 70 for the purpose of the rotation action of the shade 80 It is thus possible to significantly reduce the number of components of a power transmission mechanism, and to reduce the number of components that may malfunction accordingly As a result, it is possible to increase operational reliability.

As shown in FIG. 5, the shade 80 (more specifically, the bent part 82) includes a first restriction part 87*a* that abuts against the front surface of the bracket 61 and sets the first position for blocking a part of light The twisted coil spring 85 described above always urges the shade 80 so that the shade 80 is at the first position.

When the power supply of the solenoid 93 is switched off, the drive shaft 94 is projected, the shade 80 is reliably rotated to the first position by urging force of the twisted coil spring 85, in addition to the natural movement of the rotation action part 72 of the crank 70 in the direction of gravity, the first restriction part 87*a* of the shade 80 (more specifically, the bent part 82) abuts against the front surface of the bracket 61, the shade 80 then stops rotating, and the shade 80 is reliably at the first position for blocking a part of light.

Moreover, as shown in FIG. 5, the shade 80 (more specifically, the bent part 82) also includes a second restriction part 87*b* The second restriction part 87*b* is disposed to be opposite to the first restriction part 87*a* with the bracket 61 being interposed therebetween When the shade 80 rotates from the first position shown in FIG. 5 to the second position for not blocking light in the direction of the arrow S shown in FIG. 5, if the shade 80 rotates over the second position, the second restriction part 87*b* abuts against the rear surface of the bracket 61 to prevent excessive rotation of the shade 80.

When the power supply of the solenoid 93 is switched on, the shade 80 normally rotates based on only the retraction of the drive shaft 94 However, if the shade 80 rotates over the original second position due to vibration of the vehicle 102 (see FIG. 1) or the like, before the shade 80 excessively rotates to block light from the light source 20, the second restriction part 87*b* abuts against the rear surface of the bracket 61, the shade 80 stops rotating, and thus a good high-beam light distribution pattern is kept.

The first restriction part 87*a* and the second restriction part 87*b* are included in the shade 80, and thus the number of components is not increased.

While the present invention has been described based on the specific embodiment, the present invention is not limited to the embodiment described above Alterations and improvements without departing from the technical spirit are also included in the technical scope of the invention, which is apparent to a person skilled in the art from the description of the claims.

DESCRIPTION OF REFERENCE NUMERALS

10: Lamp unit
20: Light source
30: Heat sink
30*a*: Base
30*b*: Radiation fin
30*c*: Attachment part
31: Screw fixing hole
31*a*: Screw
32: Positioning boss
40: Reflector
50: Lens
50*a*: Light-emitting surface
50*b*: Light incident surface
51: Flange
52: Lens holder
53: Lens fixing part
53*a*: Peripheral edge
53*b*: Holding piece
54: Attachment part
54*a*: Screw hole
54*b*: Boss hole
60: Light distribution pattern switching part
61: Bracket
61*a*: Flange
61*b*: Through-hole
62: Boss hole
63: Screw hole
65: Support part
66: Movement restriction part
67: Support shaft fixing part
67*a*: Receiving part
67*b*: Holding part
68: Arm receiving part
70: Crank
71: Rotating shaft part
72: Rotation action part
73: Power transmission shaft part
73*a*: Coupling part
80: Shade
81*a*: Coupling hole
81: Crank coupling part
82: Bent part
82*a*: Shaft hole
85: Twisted coil spring
85*a*, 85*b*: Urging arm
87*a*: First restriction part
87*b*: Second restriction part
88: Receiving hole
90: Support shaft
93: Solenoid
93*a*: Rivet
94: Drive shaft
94*a*: Engagement groove
101L, 101R: Vehicle lamp
102: Vehicle

The invention claimed is:

1. A vehicle lamp comprising:
a light source;
a heat sink on which the light source is disposed;
a reflector that is disposed above the heat sink and reflects light from the light source toward a front side;
a lens that is disposed further front side than the light source and irradiates the light toward the front side; and
a light distribution pattern switching part that is disposed between the lens and the light source and switches a light distribution pattern, wherein
the light distribution pattern switching part includes
a bracket,
a crank that is supported by a support part of the bracket,
a shade that performs a rotation action to switch the light distribution pattern, and
a support shaft that rotatably supports the shade and is fixed on the bracket,
the crank includes
a rotating shaft part that extends across the bracket to be rotatably supported by the support part of the bracket, and
a rotation action part that is formed at one end of the rotating shaft part and vertically rotates about the rotating shaft part to perform a rotation action of the shade, and wherein
the support shaft is disposed to cross the rotating shaft part of the crank so as not to remove the rotating shaft part of the crank from the support part of the bracket.

2. The vehicle lamp according to claim 1, further comprising a drive unit for rotating the crank, wherein
the crank includes a power transmission shaft part that is formed at the other end of the rotating shaft part and has a coupling part coupled to the drive unit at a distal end.

3. The vehicle lamp according to claim 2, wherein
the drive unit is disposed on a vertically lower side on a side of the other end of the rotating shaft part,
the power transmission shaft part extends vertically downward from the other end of the rotating shaft part so as to form a substantially L-shape with the rotating shaft part, and the coupling part at the distal end of the power transmission shaft part is coupled to the drive unit, and
the rotation action part horizontally extends from the one end of the rotating shaft part so as to form a substantially L-shape with the rotating shaft part.

4. The vehicle lamp according to claim 2, wherein the drive unit is fixed to a rear surface of the bracket.

5. The vehicle lamp according to claim 1, wherein
the bracket includes
paired support shaft fixing parts supporting the support shaft, disposed at a vertically upper portion of the bracket on one side and the other side of the bracket in a horizontal direction, and
paired movement restriction parts restricting movement of one and the other ends of the support shaft being disposed in the support shaft fixing part, and wherein
each of the support shaft fixing parts includes
a receiving part having one end connected to the bracket and receiving the support shaft at a vertically lower portion of the receiving part, and
a holding part extending from the other end of the receiving part vertically upward, pressing the support shaft toward a side of the bracket, and holding the support shaft with the bracket.

6. The vehicle lamp according to claim 1, wherein
the shade includes
a first restriction part that abuts against a front surface of the bracket and sets a first position for blocking a part of the light, and
a second restriction part that is disposed to be opposite to the first restriction part with the bracket being interposed therebetween, and in a case where the shade rotates from the first position to a second position for not blocking the light, when the shade rotates over the second position, the second restriction part abutting against a rear surface of the bracket.

7. The vehicle lamp according to claim 1, wherein the bracket is fixed to the heat sink.

* * * * *